US008999228B2

(12) United States Patent
De Carlan et al.

(10) Patent No.: US 8,999,228 B2
(45) Date of Patent: Apr. 7, 2015

(54) PROCESS FOR MANUFACTURING A REINFORCED ALLOY BY PLASMA NITRIDING

(75) Inventors: Yann De Carlan, Avon (FR); Mathieu Ratti, Bois-Colombes (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 0 days.

(21) Appl. No.: 13/997,558

(22) PCT Filed: Dec. 22, 2011

(86) PCT No.: PCT/FR2011/053175

§ 371 (c)(1),
(2), (4) Date: Dec. 11, 2013

(87) PCT Pub. No.: WO2012/085489

PCT Pub. Date: Jun. 28, 2012

(65) Prior Publication Data

US 2014/0086783 A1 Mar. 27, 2014

(30) Foreign Application Priority Data

Dec. 24, 2010 (FR) ..... 10 61243

(51) Int. Cl.

| | |
|---|---|
| ***B22F 3/14*** | (2006.01) |
| ***C22C 1/05*** | (2006.01) |
| ***B22F 1/02*** | (2006.01) |
| ***C23C 8/36*** | (2006.01) |
| ***C23C 8/38*** | (2006.01) |
| ***C23C 8/24*** | (2006.01) |
| ***C23C 8/26*** | (2006.01) |
| ***C22C 32/00*** | (2006.01) |
| ***C22C 33/02*** | (2006.01) |

(52) U.S. Cl.
CPC ... *B22F 3/14* (2013.01); *C23C 8/24* (2013.01); *C23C 8/26* (2013.01); *C23C 8/36* (2013.01); *C23C 8/38* (2013.01); *C22C 32/0068* (2013.01); *C22C 33/0228* (2013.01); *B22F 1/02* (2013.01)

(58) Field of Classification Search
CPC ..... C23C 8/36
USPC ..... 148/222; 419/13
See application file for complete search history.

(56) References Cited

U.S. PATENT DOCUMENTS

2007/0295427 A1 12/2007 Michler

FOREIGN PATENT DOCUMENTS

WO 2004013367 A2 2/2004

*Primary Examiner* — Jessee Roe
(74) *Attorney, Agent, or Firm* — Browdy and Neimark, PLLC

(57) ABSTRACT

Process for manufacturing a reinforced alloy comprising a metallic matrix, dispersed in the volume of which are nanoparticles, at least 80% of which have a mean size from 1 nm to 50 nm, the nanoparticles comprising at least one nitride chosen from the nitrides of at least one metallic element M belonging to the group consisting of Ti, Zr, Hf and Ta. The process comprises the following successive steps: a) plasma nitriding of a base alloy is carried out at a temperature from 200° C. to 700° C. in order to insert interstitial nitrogen therein, the base alloy incorporating 0.1% to 1% by weight of the metallic element M and being chosen from an austenitic, ferritic, ferritic-martensitic or nickel-based alloy; b) the interstitial nitrogen is diffused within the base alloy at a temperature of 350° C. to 650° C.; and c) the nitride is precipitated at a temperature from 600° C. to 900° C. over a duration of 10 minutes to 10 hours, in order to form the nanoparticles dispersed in the reinforced alloy.

27 Claims, 1 Drawing Sheet

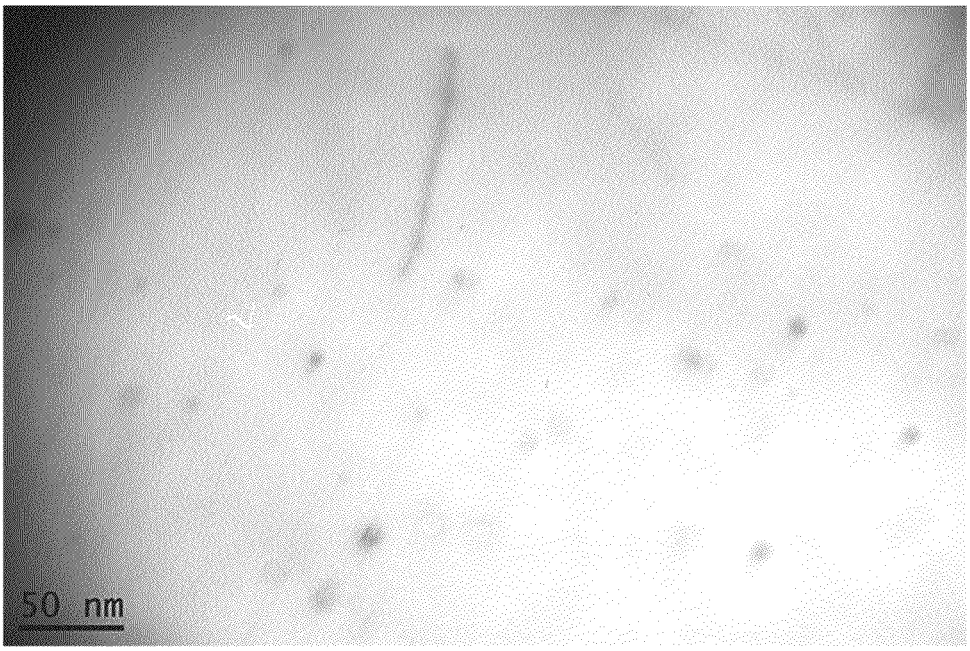
50 nm

PROCESS FOR MANUFACTURING A REINFORCED ALLOY BY PLASMA NITRIDING

TECHNICAL FIELD

The present invention relates to a production method of a strengthened alloy. It more particularly relates to a production method of an alloy strengthened by metal nitride nanoparticles.

TECHNICAL BACKGROUND

Alloys strengthened by nitride particles (referred to as "NDS", standing for "Nitride Dispersion Strengthened"), have improved mechanical properties compared with master alloys, among others better mechanical tensile, creep, compressive or fatigue strength.

These properties may be further improved by reducing the size of the dispersed particles.

Numerous studies thus aim to develop a production method of an NDS alloy with particles of reduced size.

Among these methods, gas nitriding is frequently employed. The document "Johansson et at., Nitrogen alloyed stainless steel produced by nitridation of powder, Metal Powder Report, 1991, 46 (5), pp. 65-68", describes a method in which an austenitic steel powder containing titanium is heated to around 1000° C. under a pure dinitrogen ($N_2$) atmosphere in order to form precipitates of an intermediate nitride, chromium nitride $Cr_2N$. Under the action of a supplementary heat treatment at 1200° C., these precipitates are then dissolved in order to result in an alloy strengthened by titanium nitride dispersions.

The supplementary heat treatment of this nitriding method nevertheless has the drawback of producing dispersions of an average size that may be as large as 300 nm. This large size of the dispersion has a tendency to degrade the mechanical properties of the strengthened alloy.

Another type of production method used for an NDS alloy involves powder metallurgy. In the document U.S. Pat. No. 4,708,742, a powder of a nitrogen donor compound (such as $Cr_2N$) is co-milled with a powder intended to form the metal matrix of a strengthened alloy. The blend of powders obtained is subjected to heat treatment in order to decompose the nitrogen donor so that the dinitrogen thus available forms a nitride with one of the elements of the metal matrix. After consolidation of the blend of powders, an alloy strengthened by nitride dispersions is obtained.

The heat treatment intended to produce dinitrogen by decomposition of the nitrogen donor means that this powder metallurgy method may be assimilated to a nitriding method.

The requirement to have available an intermediate nitride such as $Cr_2N$ before forming the final metal nitride therefore also has an unfavorable effect on the size of the dispersed nanoparticles, which is at best around one micrometer.

The aforementioned methods of the prior art therefore have a particular drawback in that they do not make it possible to produce a strengthened alloy in which the nanoparticles mainly have a reduced average size, typically less than 50 nm.

In addition, the requirement to proceed by an intermediate nitride means that these methods are subject to parasitic reactions that make it difficult to control the composition and quantity of the particles that are present in the strengthened alloy obtained.

DISCLOSURE OF THE INVENTION

One of the aims of the invention is therefore to implement a production method of an NDS alloy comprising nanoparticles of which at least 80% have an average size of less than 50 nm, such a method being able to afford better control of the composition and quantity of these nanoparticles in the alloy.

The present invention thus relates to a production method of a strengthened alloy comprising a metal matrix in the volume of which nanoparticles are dispersed, of which at least 80% have an average size of 1 nm to 50 nm, the nanoparticles comprising at least one nitride chosen from the nitrides of at least one metal element M belonging to the group consisting of Ti, Zr, Hf and Ta.

This method comprises the following successive steps:

a) performing plasma nitriding of a base alloy at a temperature of 200° C. to 700° C. in order to insert interstitial nitrogen therein, the base alloy incorporating 0.1% to 1% by weight of the metal element M and being chosen from an austenitic, ferritic, ferritic-martensitic or nickel-based alloy;

b) diffusing the interstitial nitrogen in the base alloy at a temperature of 350° C. to 650°C.; and c) precipitating the nitride at a temperature of 600° C. to 900° C. for a period of 10 minutes to 10 hours, in order to form the nanoparticles dispersed in the strengthened alloy.

Advantageously, the method of the invention does not proceed by an intermediate nitride intended to form the metal nitride constituting the whole or part of the dispersed nanoparticles.

This is made possible by means of the production method of the invention, which comprises separate steps.

Thus, during the plasma nitriding step followed by the diffusion step, the nitrogen intended to form the nitride is introduced into the base alloy in interstitial form, namely as nitrogen in solid solution in the base alloy, rather than in $N_2$ molecular form.

Through its preferential chemical affinity with the metal element M, the interstitial nitrogen then combines directly with the whole or part of this element, under the influence of the diffusion and/or precipitation temperature (generally under the influence of a temperature of between 500° C. and 65° C.), in order to form the nitride. Where applicable, for a temperature in a common range of between 600° C. and 650° C. among others, the diffusion and precipitation step can therefore overlap wholly or partly.

During step c), the nitride is precipitated by means of a germination-growth phenomenon in order to form the nanoparticles dispersed in the strengthened alloy.

In the context of the invention, it is therefore not necessary to proceed by an intermediate nitride, unlike the methods of the prior art, which require supplementary heat treatment generally carried out at a temperature of approximately 1200° C. in order to dissociate a nitride such as $Cr_2$ N.

Another advantage of the production method of the invention is that the temperature applied during the various steps thereof can be chosen with great freedom.

Thus the plasma nitriding step a) is performed at a temperature of 200° to 700° C., preferably 200° C. to 600° C., even more preferably 350° C. to 450° C.

Step b) diffusing the interstitial nitrogen is for its part performed at a temperature of 350° C. to 650° C., preferably 350° C. to 500° C. Its duration is generally from 5 hours to 500 hours, preferably from 10 hours to 200 hours. It is generally inversely proportional to the temperature of the interstitial nitrogen diffusion step.

Once the nitrogen is diffused in interstitial form in the base alloy, the precipitation temperature can advantageously be chosen so as to control the size of the nitride of the metal element M to the detriment of the precipitation of a metal element M' such as Cr, the dissolution of the associated nitride $Cr_2N$ being able to take place only at a temperature of around 1100° C.

After direct combination of the interstitial nitrogen with the whole or part of the metal element M in order to form the nitride, step c) nitride precipitating is performed at a temperature from 600° C. to 900° C., preferably from 600° C. to 800° C., even more preferably from 600° C. to 700° C. Its duration is from 10 minutes to 10 hours, preferably from 30 minutes to 2 hours. It is generally inversely proportional to the temperature of the nitride precipitation step.

Such a choice of temperature is not accessible to the methods of the prior art since the reactivity of the nitriding medium requires an implementation temperature for them that, is higher and/or with a more restricted choice.

The absence of intermediate nitride and/or the freedom of choice in the implementation temperature of the method of the invention means that this method makes it possible to obtain a strengthened alloy the matrix of which comprises dispersed nanoparticles with an average size smaller than those obtained by the methods of the aforementioned prior art.

DETAILED DISCLOSURE OF THE INVENTION

In the present description, the verb "comprise", "contain", "incorporate", "include" and the conjugate forms thereof are open terms and therefore do not exclude the presence of additional element(s) and/or step(s) added to the initial element(s) and/or step(s) stated after these terms. However, these open terms also refer to a particular embodiment in which only the initial element(s) and/or step(s), to the exclusion of any other, are referred to; in which case the open term also refers to the closed term "consist of", "constitute" and the conjugate forms thereof.

The use of the indefinite article "a" or "an" for an element or step does not exclude, unless mentioned otherwise, the presence of a plurality of elements or steps.

Unless indicated otherwise, the chemical composition of the base alloy, of the strengthened alloy or of the metal matrix and the nanoparticles that it contains is expressed in the present description as a percentage by weight with respect to the weight of the alloy in question.

Step a) of the production method of the invention consists of plasma nitriding as known to persons skilled in the art, described for example in the document "Techniques de l'ingenieur", reference M 1227, "Nitraration, nitrocarburation et dérivés", Chapter 4.

It comprises mainly the formation of a plasma by imposing a potential difference between an anode and a cathode in a gaseous medium comprising nitrogen, so that reactive species are produced. The reactive species may comprise neutral species (atomic N), or even ionized or excited species (such as for example $N^+$ or $N_2$ excited by vibration), the nitriding then being said to be ionic in the latter case. By means of appropriate heat treatments, these species diffuse in interstitial form in the base alloy in order then to form a nitride with atoms constituting this alloy.

According to the invention, plasma nitriding is performed on a base alloy incorporating 0.1% to 1% by weight of at least one metal element M chosen from Ti, Zr, Hf, or Ta, preferably 0.5% to 1% by weight of this element.

Preferably, the metal element M is titanium.

The base alloy may be in powder or piece form.

It is chosen from an austenitic, ferritic, ferritic-martensitic or nickel-based alloy.

The plasma nitriding may be performed by means of a gaseous medium comprising nitrogen (in the form of molecular nitrogen ($N_2$) and/or as a gaseous nitrogenous compound such as for example $NH_3$ and/or $N_2H_2$). The nitrogen is diluted in a chemically inert gas (vis-à-vis other constituents of the gaseous medium), such as for example $H_2$.

The gaseous medium may also comprise a carbonaceous species, such as for example $CH_4$.

The gaseous medium may for example comprise 20% to 30% by volume of $N_2$ and/or gaseous nitrogenous compound, possibly with the carbonaceous species (for example $CH_4$) added to the extent of 5% to 20% by volume, the remainder consisting of the chemically inert gas (for example $H_2$).

The pressure of the gaseous medium is generally less than atmospheric pressure, for example from 1 mbar to 100 mbar, preferably from 1 mbar to 10 mbar, even more preferably from 1.5 mbar to 5 mbar.

The plasma nitriding is generally performed for a period of from 5 hours to 300 hours, preferably from 10 hours to 200 hours, even more preferably from 24 hours to 100 hours.

Preferably, after the nitrogen diffusion step, the base alloy comprises 1000 ppm to 2000 ppm by weight of nitrogen in interstitial form, which allows the preferential formation of a nitride of the metal element M to the detriment of other nitrides such as $Cr_2N$.

At the end of the production method of the invention, the strengthened alloy obtained comprises a metal matrix in which nanoparticles composed in whole or in part of at least one metal nitride are dispersed.

The metal matrix of the strengthened alloy has the chemical composition of the base alloy.

The production method of the invention also preserves the structure of the base alloy (austenitic, ferritic or ferritic-martensitic structure) in the strengthened alloy.

The nanoparticles are dispersed in the whole or part of the volume of the strengthened alloy. They usually represent 0.5% to 2% (typically 1%) of the volume of the strengthened alloy.

When the base alloy is in piece form, the nanoparticles are dispersed in the strengthened alloy over a depth that may lie between 30 μm and 1 mm, preferably between 50 μm and 500 μm, even more preferably between 50 μm and 100 μm.

At least 80% of the nanoparticles have an average size of 1 nm to 50 nm, preferably at least 90% an average size of 1 nm to 10 nm, even more preferably at least 95% an average size of 0.5 nm to 5 nm.

In order to obtain such a reduction in size, the average size of the nanoparticles can be modulated by varying parameters such as the plasma nitriding temperature, the diffusion temperature, and/or the pressure of the gaseous medium.

It can also be reduced by decreasing the temperature and/or the duration of the precipitation step e), which are for example 850° C. for 1 hour.

Within the meaning of the invention, "average size" means the average value of the diameter of the nanoparticles when they are substantially spherical, or the average value of their principal dimensions when they are not substantially spherical.

The quantity of nanoparticles (at least 80%) having a given average size can easily be counted by means of a technique known to persons skilled in the art such as Transmission Electronic Microscopy (TEM).

The nanoparticles generally have a composition such that they comprise, by atomic percentage, 30% to 70% nitrogen, combined in nitride form with at least one metal element M. This quantity depends on the quantity of interstitial nitrogen introduced into the base alloy, knowing that generally all the interstitial nitrogen combines with the metal element M.

When the carbon element is also present in the gaseous medium in the form of a carbonaceous species, the whole or part of this element may combine directly with the metal element M and possibly the nitrogen during the plasma nitriding. Then nanoparticles are obtained in which the nitride is wholly or partly in the form of carbonitride of the metal element M.

As is known to persons skilled in the art in the metallurgy field, the nitride or carbonitride of the metal element M formed does not necessarily have a defined stoichiometry. These species are represented most often by the formula M(N) or M(C,N), or alternatively the formula $M_xC_yN_z$, in which the indices "x", "y" and "z" indicate respectively the relative atomic proportions of the elements M, C and N in the nitride or carbonitride formed.

The nitride of a metal element M may however comprise one or several nitrides with a defined stoichiometry, which may where applicable coexist in the nanoparticles. For example, titanium nitride may be present in a nanoparticle in the form TiN and/or $Ti_3N_4$.

Preferably, the nitride present in the nanoparticles thus belongs to the group consisting of TiN, $Ti_3N_4$, ZrN, HfN and TaN.

Of course the nanoparticles may also comprise other species that were initially present in the powders or which formed during the production method of the invention.

The strengthened alloy may also comprise, by weight, at least one of the following elements (sometimes as an inevitable production impurity):

from 10 to 120 ppm of silicon;
from 10 to 100 ppm of sulfur;
less than 20 ppm of chlorine;
from 2 to 10 ppm of phosphorus;
from 0.1 to 10 ppm of boron;
from 0.1 to 10 ppm of calcium;
less than 0.1 ppm of each of the following elements: lithium, fluorine, heavy metals, Sn, As, Sb.

The production method of the invention may comprise a step of consolidation by hot extrusion performed during (possibly in place of) or after step c) precipitating the nitride, preferably at a temperature of less than or equal to 850° C., preferably at a temperature of 600° C. to 850° C. This hot extrusion step is preferably implemented when the base alloy is in powder form.

Other objects, features and advantages of the invention will now be specified in the following description of a particular embodiment of the invention, given by way of illustration and non-limitatively, with reference to the accompanying FIG. 1.

BRIEF DESCRIPTION OF THE FIGURES

FIG. 1 shows a TEM photograph of a strengthened alloy obtained by the production method of the invention.

DISCLOSURE OF A PARTICULAR EMBODIMENT

A ferritic powder composed of an Fe-18Cr-1W-0.8Ti base alloy is nitrided by means of the production method of the invention.

This powder has a granulometry such that the average size of its grains is 100 μm.

The conditions for implementing the method are as follows:

stirring of the powder;
gaseous medium consisting by volume of 71% $H_2$, 23% $N_2$ and 6% $CH_4$;
pressure of the gaseous medium of 2.5 mbar;
cycle of 15 hours plasma nitriding performed at 380° C., followed by a diffusion heat treatment performed at a temperature of 400° C. for 200 hours.

An analysis by TEM of the powder obtained shows the absence of nitride precipitation.

Consolidation is then performed by means of hot extrusion at 850° C. for 1 hour, during which the titanium nitride precipitates.

A sample taken at the core of the strengthened alloy obtained is examined by TEM. The photograph obtained shown in FIG. 1 shows the presence of numerous particles comprising titanium nitride with an average size of between 2 nm and 8 nm.

The invention claimed is:

1. Production method of a strengthened alloy comprising a metal matrix in the volume of which nanoparticles are dispersed, of which at least 80% have an average size of 1 nm to 50 nm, said nanoparticles comprising at least one nitride chosen from the nitrides of at least one metal element M belonging to the group consisting of Ti, Zr, Hf and Ta, the method comprising the following successive steps:

a) performing plasma nitriding of a base alloy at a temperature of 200° C. to 700° C. in order to insert interstitial nitrogen therein, said base alloy incorporating 0.1% to 1% by weight of the metal element M and being chosen from an iron-based austenitic, ferritic, or ferritic-martensitic alloy or a nickel-based alloy;
b) diffusing the interstitial nitrogen in said base alloy at a temperature of 350° C. to 650° C.; and
c) precipitating the nitride at a temperature of 600° C. to 900° C. for a period of 10 minutes to 10 hours, in order to form said nanoparticles dispersed in the strengthened alloy.

2. Production method according to claim 1, wherein:

plasma nitriding is performed according to step (a) at a temperature of 200° C. to 600° C.;
the interstitial nitrogen is diffused according to step (b) at a temperature of 350° C. to 500° C.; and
the nitride is precipitated according to step (c) at a temperature of 600° C. to 800° C.

3. Production method according to claim 2, wherein plasma nitriding is performed according to step (a) at a temperature of 350° C. to 450° C.

4. Production method according to claim 1, wherein said base alloy incorporates 0.5% to 1% by weight of the metal element M.

5. Production method according to claim 1, wherein the plasma nitriding is performed by means of a gaseous medium comprising nitrogen in the form of molecular nitrogen ($N_2$) and/or as a gaseous nitrogenous compound.

6. Production method according to claim 5, wherein the gaseous nitrogenous compound is $NH_3$and/or $N_2H_2$.

7. Production method according to claim 5, wherein the gaseous medium comprises 20% to 30% by volume of $N_2$and/or of the gaseous nitrogenous compound, the remainder consisting of the chemically inert gas.

8. Production method according to claim 5, wherein the gaseous medium also comprises a carbonaceous species.

9. Production method according to claim 8, wherein the carbonaceous species is $CH_4$.

10. Production method according to claim 8, wherein the gaseous medium comprises 20% to 30% by volume of $N_2$and/or of the gaseous nitrogenous compound, with the carbonaceous species added to the extent of 5% to 20% by volume, the remainder consisting of the chemically inert gas.

11. Production method according to claim 1, comprising a step of consolidation by hot extrusion performed during or after the step c) precipitating the nitride.

12. Production method according to claim 11, wherein the hot extrusion step is performed at a temperature of less than or equal to 850° C.

13. Production method according to claim 1, wherein the strengthened alloy also comprises by weight at least one of the following elements:

from 10 to 120 ppm of silicon;
from 10 to 100 ppm of sulfur;
less than 20 ppm of chlorine;
from 2 to 10 ppm of phosphorus;
from 0.1 to 10 ppm of boron;
from 0.1 to 10 ppm of calcium;
less than 0.1 ppm of each of the following elements: lithium, fluorine, heavy metals, Sn, As, Sb.

14. Production method according to claim 1, wherein the nitride is selected from the group consisting of TiN, $Ti_3N_4$, ZrN, HfN and TaN.

15. Production method according to claim 1, wherein the nitride is wholly or partly in the form of carbonitride of the metal element M.

16. Production method according to claim 1, wherein at least 90% of said nanoparticles have an average size of 1 nm to 10 nm.

17. Production method according to claim 1, wherein plasma nitriding is performed according to step (a) at a temperature of 200° C. to 600° C.

18. Production method according to claim 1, wherein the interstitial nitrogen is diffused according to step (b) at a temperature of 350° C. to 500° C.

19. Production method according to claim 1, wherein the nitride is precipitated according to step (c) at a temperature of 600° C. to 800° C.

20. Production method according to claim 19, wherein the nitride is precipitated according to step (c) at a temperature of 600° C. to 700° C.

21. Production method according to claim 1, wherein the interstitial nitrogen is diffused according to step (b) for a duration from 5hours to 500hours.

22. Production method according to claim 1, wherein the base alloy is an iron-based austenitic alloy or a nickel-based austenitic alloy.

23. Production method according to claim 22, wherein the base alloy is an iron-based austenitic, ferritic, or ferritic-martensitic alloy.

24. Production method according to claim 23, wherein the base alloy is an iron based ferritic alloy.

25. Production method according to claim 1, wherein the nanoparticles represent 0.5% to 2% of the volume of the strengthened alloy.

26. Production method according to claim 1, wherein the metal element M is titanium.

27. Production method according to claim 1, wherein the base alloy is a nickel-based alloy.

* * * * *